US006056136A

United States Patent [19]

Taber et al.

[11] Patent Number: 6,056,136

[45] **Date of Patent: *May 2, 2000**

[54] LUG CLOSURE FOR PRESS-ON APPLICATION TO, AND ROTATIONAL REMOVAL FROM, A THREADED NECK CONTAINER

[75] Inventors: James Taber, Aurora; Benjamin Mann, Darien; Mark Petersen, Warrenville, all of Ill.

[73] Assignee: White Cap, Inc., Downers Grove, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/565,002

[22] Filed: Nov. 30, 1995

[51] Int. Cl.[7] ..... B65D 39/00; B65D 45/02

[52] U.S. Cl. ..... 215/252; 215/318; 215/330

[58] Field of Search ..... 215/318, 329, 215/262, 270, 216, 217, 218, 222, 252, 295, 276; 220/288, 293, 295, 296, 301, 302

[56] References Cited

U.S. PATENT DOCUMENTS

| | | | |
|---|---|---|---|
| 1,548,459 | 8/1925 | Hammer | 215/330 |
| 3,069,040 | 12/1962 | Corsette | 215/318 |
| 3,270,904 | 9/1966 | Foster et al. | 215/318 |
| 3,344,942 | 10/1967 | Hedgewick . | |
| 3,555,606 | 1/1971 | Hedgewick . | |
| 3,608,764 | 9/1971 | Hedgewick . | |
| 3,741,423 | 6/1973 | Acton et al. | 215/318 |
| 3,756,445 | 9/1973 | Hedgewick . | |
| 3,794,200 | 2/1974 | Marks | 215/318 X |
| 3,888,383 | 6/1975 | Rowlands | 220/293 X |
| 3,913,771 | 10/1975 | Acton et al. | 215/256 |
| 3,917,906 | 11/1975 | Hedgewick . | |
| 4,000,825 | 1/1977 | Westfall | 215/318 |
| 4,223,795 | 9/1980 | Akers . | |
| 4,275,817 | 6/1981 | Patton . | |
| 4,298,129 | 11/1981 | Stull | 215/318 X |
| 4,325,487 | 4/1982 | Libit | 215/330 |
| 4,346,809 | 8/1982 | Kusz . | |
| 4,434,903 | 3/1984 | Cooke . | |
| 4,444,327 | 4/1984 | Hedgewick . | |
| 4,478,343 | 10/1984 | Ostrowsky | 215/252 |
| 4,485,932 | 12/1984 | Kusz . | |
| 4,552,279 | 11/1985 | Mueller et al. | 215/318 |
| 4,579,238 | 4/1986 | Herr . | |
| 4,717,034 | 1/1988 | Mumford . | |
| 4,721,219 | 1/1988 | Dullabaun et al. | 215/318 X |

(List continued on next page.)

FOREIGN PATENT DOCUMENTS

| | | | |
|---|---|---|---|
| 2063226 | 6/1981 | United Kingdom | 215/318 |

*Primary Examiner*—Allan N. Shoap
*Assistant Examiner*—Joe Merek
*Attorney, Agent, or Firm*—Cook, Alex, McFarron, Manzo, Cummings & Mehler, Ltd.

[57] ABSTRACT

A closure for press-on application to, and rotational removal from, a container having a cylindrical neck which includes a plurality of vertically spaced helical threads formed in the outer surface thereof in generally parallel relationship to each other. A flexible cylindrical skirt, preferably composed of a polyolefin such as polypropylene, includes a plurality of radially inwardly projecting spaced lugs that are circumferentially disposed around the inner cylindrical skirt surface and axially spaced therefrom for engagement with the threads on the cylindrical neck of the container. The lugs are composed of a deformable plastic material and are sized so that when the closure is applied to the container, an interference fit is provided between at least some of the lugs and at least some of the threads. The flexible skirt and lugs are sized to permit the closure to be applied to the container by a direct axial, press-action without requiring rotation thereof to effect the desired sealing of the closure on the container. When the closure is to be removed from the container, a rotational movement thereof causes at least some of the lugs which are at least partially received within helical grooves defined by the vertically spaced helical threads to engage upwardly inclined surfaces on the threads, thereby providing an upward camming action to the closure.

41 Claims, 7 Drawing Sheets

U.S. PATENT DOCUMENTS

| | | | |
|---|---|---|---|
| 4,739,890 | 4/1988 | Cooke . | |
| 4,813,561 | 3/1989 | Ochs | 215/276 X |
| 4,863,030 | 9/1989 | Bayer et al. | 215/318 X |
| 4,989,740 | 2/1991 | Vercillo | 215/318 X |
| 4,993,572 | 2/1991 | Ochs | 215/276 X |
| 5,062,538 | 11/1991 | Ochs | 215/276 X |
| 5,135,124 | 8/1992 | Wobser . | |
| 5,240,131 | 8/1993 | Keller | 215/276 X |
| 5,267,661 | 12/1993 | Luch et al. | 215/318 X |
| 5,307,946 | 5/1994 | Molinaro | 215/318 X |
| 5,320,233 | 6/1994 | Welch . | |
| 5,685,443 | 11/1997 | Taber et al. | 215/252 |

LUG CLOSURE FOR PRESS-ON APPLICATION TO, AND ROTATIONAL REMOVAL FROM, A THREADED NECK CONTAINER

TECHNICAL FIELD OF THE INVENTION

The present invention generally relates to new and improved closures for press-on or non-rotary application to a glass or plastic container which closures require twisting or rotational action for removal from such containers and, more particularly, to a closure of this type which includes a flexible skirt having a plurality of inwardly projecting lugs for engagement with a multi-lead thread configuration on the neck portion of a container to be sealed therewith.

BACKGROUND OF THE INVENTION

Commercially available PT closures (i.e. those enabling press-on or non-rotary application to a container but requiring rotational or twisting removal) are commonly lined with a conventional plastisol gasket compound that is arranged to be in sealing engagement with the top edge or finish of a container and along the neck portion thereof. When first formed, these containers have a cylindrical bore which is adapted to provide an interference fit with the screw thread on the container neck, thereby enabling the closure to be directly applied to the container without requiring rotation thereof. During thermal processing of the container after the filling or capping thereof, this lining takes a set by which it permanently conforms to the container's helical thread(s) enabling subsequent rotational removal of the closure from the container by the user.

While these commercial closures have found general acceptance in the trade, efforts have been undertaken by those involved in this art to eliminate the need for utilizing a thread-forming lining on the interior of such closures. One such alternative closure construction is shown in U.S. Pat. No. 4,717,034 (Mumford) which describes a one-piece cap shell closure formed of thermoplastic material for capping containers having a plurality of vertically spaced multi-lead threads on the neck surface thereof. The skirt portion of the closure includes a plurality of spaced-apart, flexible and generally vertical thermoplastic ribs which are integral with the skirt each of which is sized to engage a plurality of threads. These ribs are so constructed and arranged that they impart sufficient resistance to cold flow so that the rib only slightly flexes and bends around the threads to form slight indentations on the ribs when such ribs are forced into contact with the threads. These axial-ribbed closures have not, insofar as applicants are aware, found commercial acceptance. The failure of such closures to find such acceptance by the trade is believed to be due to the inability of the vertical ribs to provide sufficient lifting, particularly under vacuum conditions, with conventionally employed thread designs used in currently available glass containers for use with press-on/rotationally removable closures.

The present invention overcomes the problems and disadvantages of these prior art closures and provides a new and improved closure having significant advantages thereover.

SUMMARY OF THE INVENTION

In accordance with the present invention, a new and improved closure is provided for press-on application to, and rotational removal from, a container having a cylindrical neck that includes a plurality of vertically spaced helical threads formed on the outer surface thereof. The closures of this invention include a flexible cylindrical skirt that extends downwardly from an end panel which skirt is provided with a plurality of integrally formed radially inwardly projecting spaced lugs that are circumferentially disposed around the inner cylindrical skirt surface and axially spaced thereon for engagement with the threads when the closure is seated on the container in sealing relationship therewith. The skirt and lugs are composed of a deformable plastic material (preferably polypropylene) and are sized and arranged to permit the closure to be applied to the container by direct axial, press-on action without requiring rotation thereof to effect the desired sealing of the closure on the container. This sealing is achieved by an interference fit being achieved between the lugs which are in direct contact with the maximum outer extent of threads on the container. Each of the spaced lugs has an axial height such that it will only be in contact with a single helical thread when the closure is in sealing relationship on the container. The lugs also have a circumferential length which in association with such axial height enables at least some of them to be at least partially received within the helical grooves formed by the spaced helical threads on the container so that, upon rotational removal of the closure, a leading edge on a lug received within such a groove will engage an upwardly inclined surface on an adjacent thread, thereby providing an upward camming action to the closure during such removal rotation.

It is, therefore, an object of the present invention to provide an improved closure which can be applied to a container by a direct, axial press-on action.

Another object of the present invention is to provide an improved press-on/rotationally removable closure which does not require the use of a curable elastomeric thread-forming deposit on the interior of the skirt and which, at the same time, does not require any special registration between the closure and the container to achieve the desired sealing when the closure is applied to the container.

Another object of the present invention is to provide an improved closure of the press-on/rotationally removable type for application to a glass or plastic container having a neck finish area that includes a multi-lead thread configuration which closure can be repeatedly pressed or snap fitted onto the container (without requiring any cinching) but which is readily removed by a twisting or rotational movement.

Another object of the present invention is to provide an improved press-on/rotationally removable closure which will permit the achievement of desired venting or pressure release without adversely effecting the force required for rotational removal of said closure.

These and other objects of the present invention will be apparent from the following detailed description taken in conjunction with the accompanying drawings in which like reference numerals refer to like parts.

DETAILED DESCRIPTION OF THE PREFERRED EMBODIMENT

Figure 1:
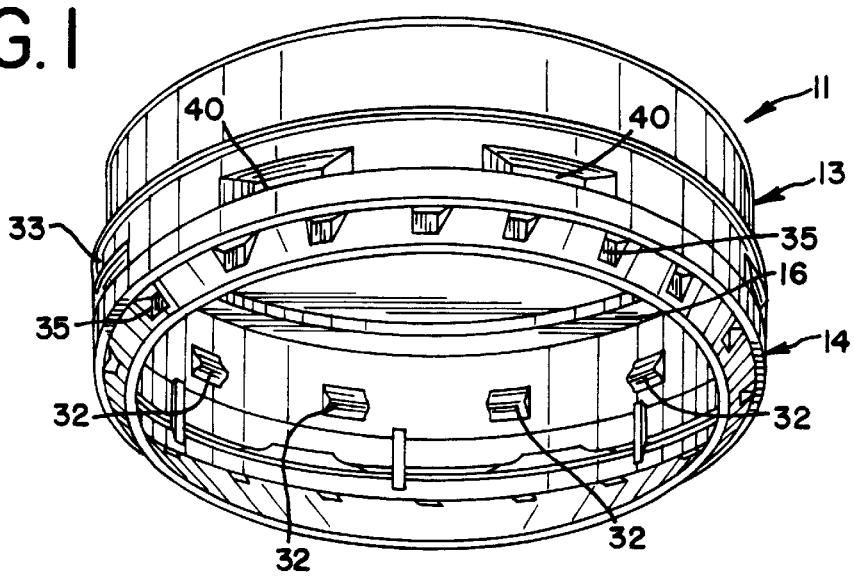
FIG. 1 is a perspective view of a lug cap or closure illustrating the inside skirt portion thereof and also showing the tamper band portion thereof in its as formed or downwardly extending position.

Referring to the drawings, and with particular reference to FIGS. 1–4, a closure cap embodying the present invention is generally designated by the reference numeral 11. Closure cap 11 is suitable for a variety of applications such as, for example, the hot fill packing of food products. As shown, closure cap 11 includes an end panel 12, a flexible skirt 13 extending downwardly therefrom, a tamper indicating band 14 integrally formed with the skirt 13 and a gasket 16.

Figure 2:
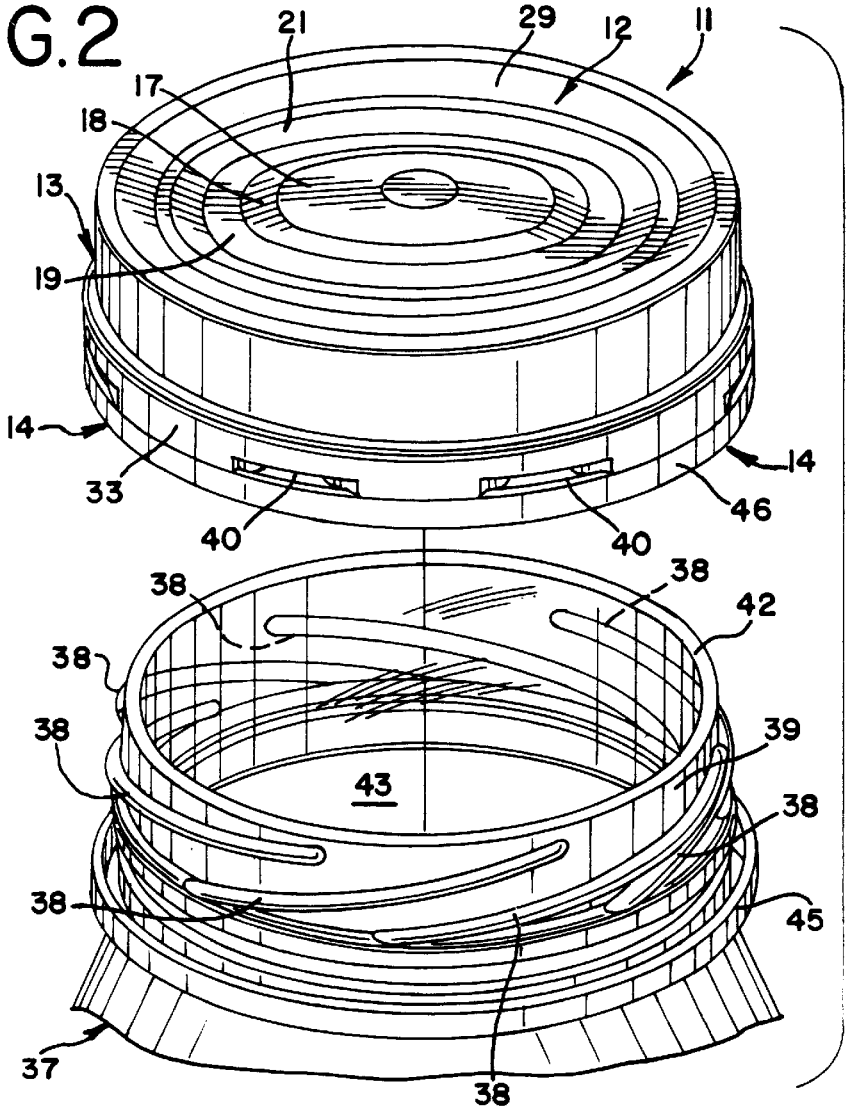
FIG. 2 is a perspective view of a lug cap or closure of the present invention showing the upper surface of the top panel thereof and with the tamper bank inwardly folded in overlying relation to a complementary container according to the present invention.
Figure 4:
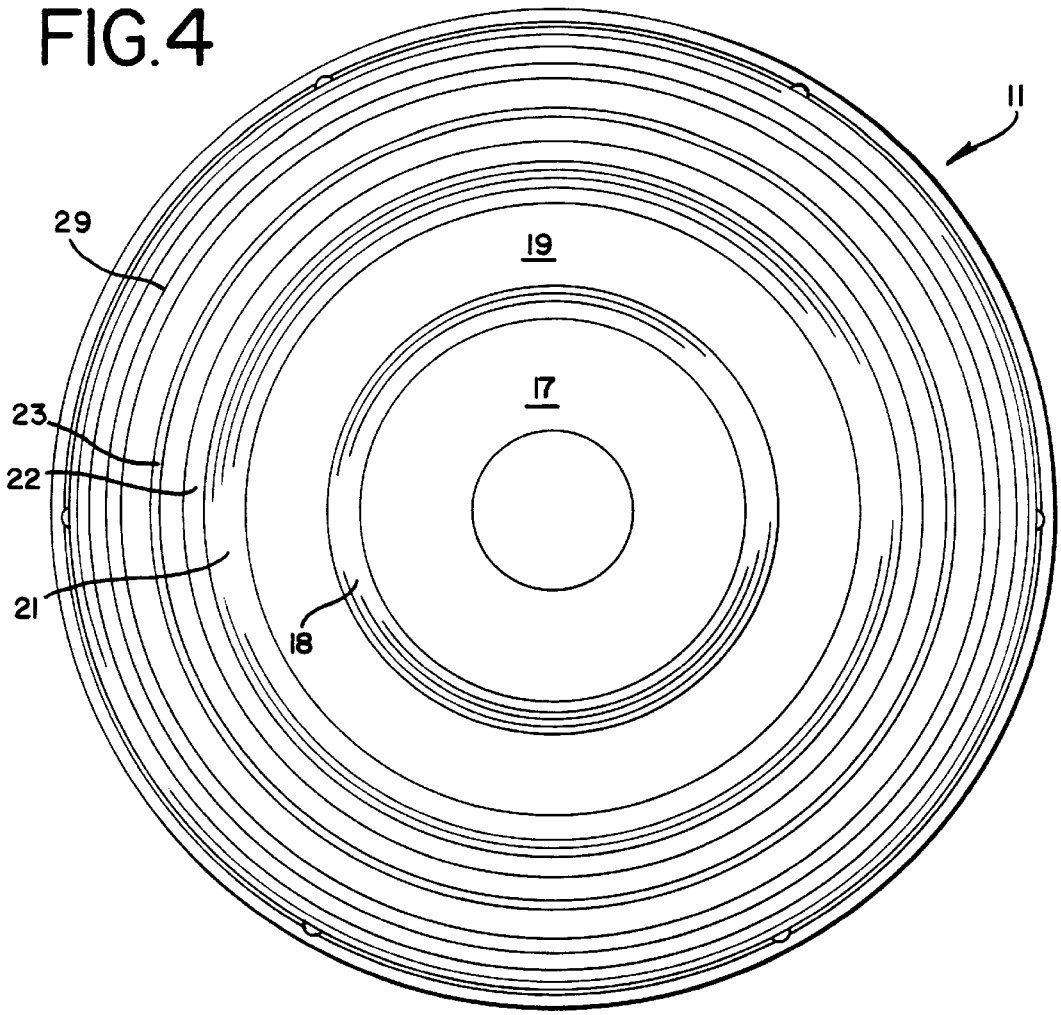
FIG. 4 is a top plan view of the closure shown in FIGS. 1–3.
Figure 6:
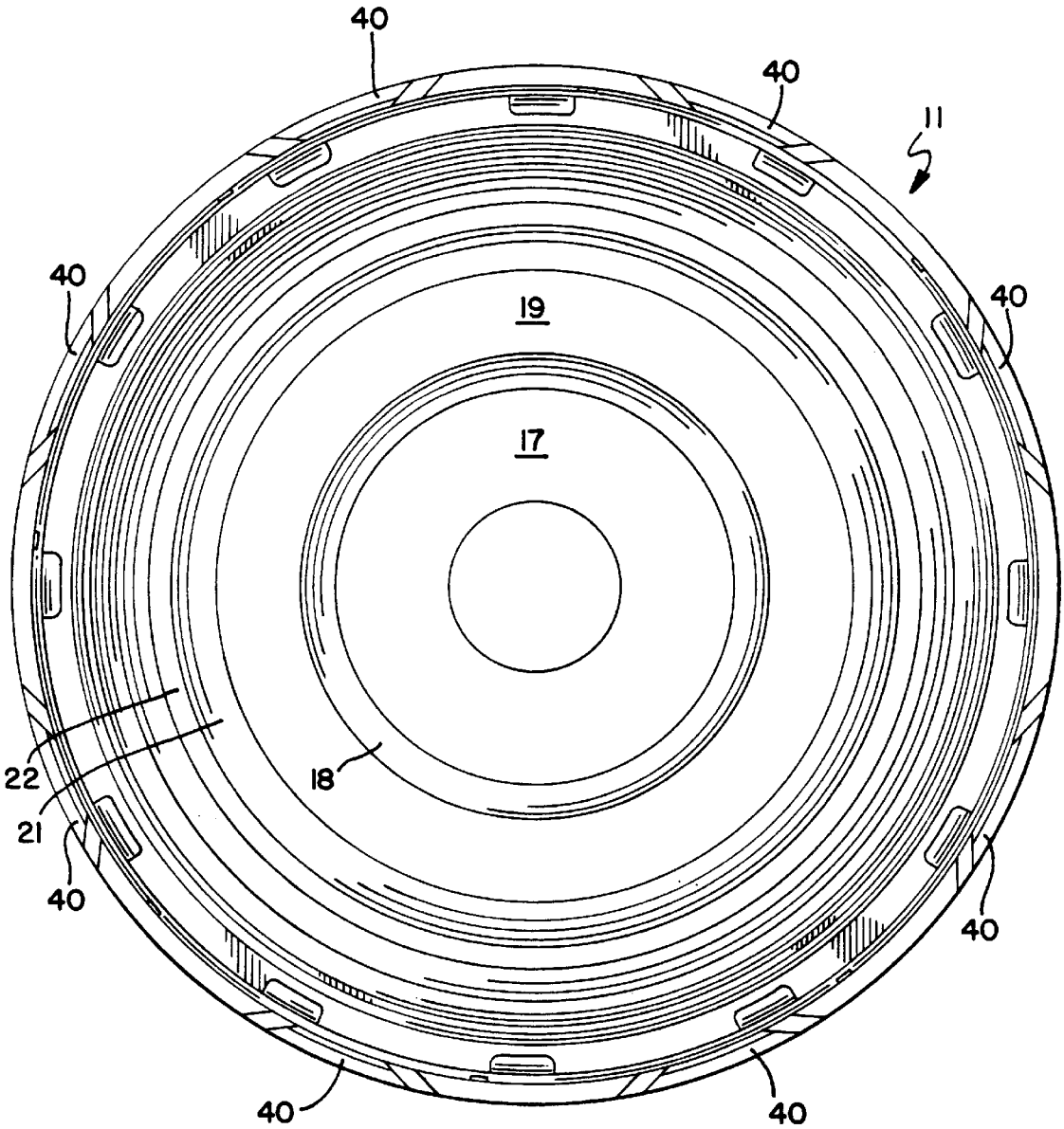
FIG. 6 is a sectional view taken along the lines 6—6 of the closure cap shown in FIG. 3.

In the illustrated embodiment, end panel 12 is formed of metal, however, other materials exhibiting suitable oxygen barrier or oxygen scavenging properties can also be used such as, for example, Saran or EVOH type materials, nylons and other thermoplastic and thermoset resins and composite structures known in the art. As best shown in FIGS. 2, 4 and 6, end panel 12, in the illustrated embodiment, includes an upwardly projecting button 17 at the radial innermost portion thereof which sequentially extends radially outwardly into a downwardly and outwardly inclined flange 18, a flat 19, an upwardly and outwardly inclined flange 21, an annular flat 22, a downwardly and radially outwardly inclined flange 23, a radially extending annular flat 24, a downwardly curved section 26 and a radially and axially downwardly extending section 27 which terminates in a free or cut edge 28. As is known in the art, the creation of a vacuum condition in the container to which the closure is applied will result in a downwardly axial movement and depression of the panel and button 17, while release of the vacuum will cause the panel and button to return to their as-formed position shown in FIG. 2.

Figure 3:
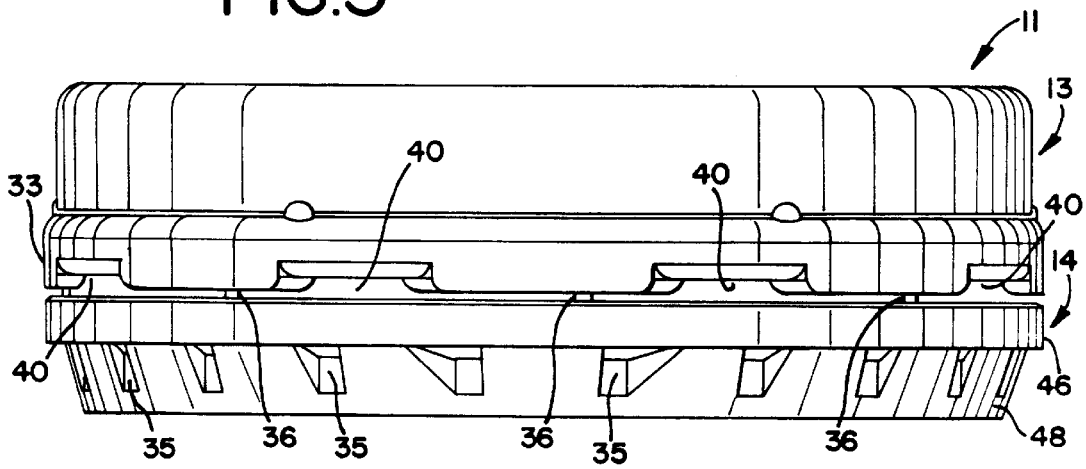
FIG. 3 is an elevational view of the closure shown in FIGS. 1 and 2.
Figure 5:
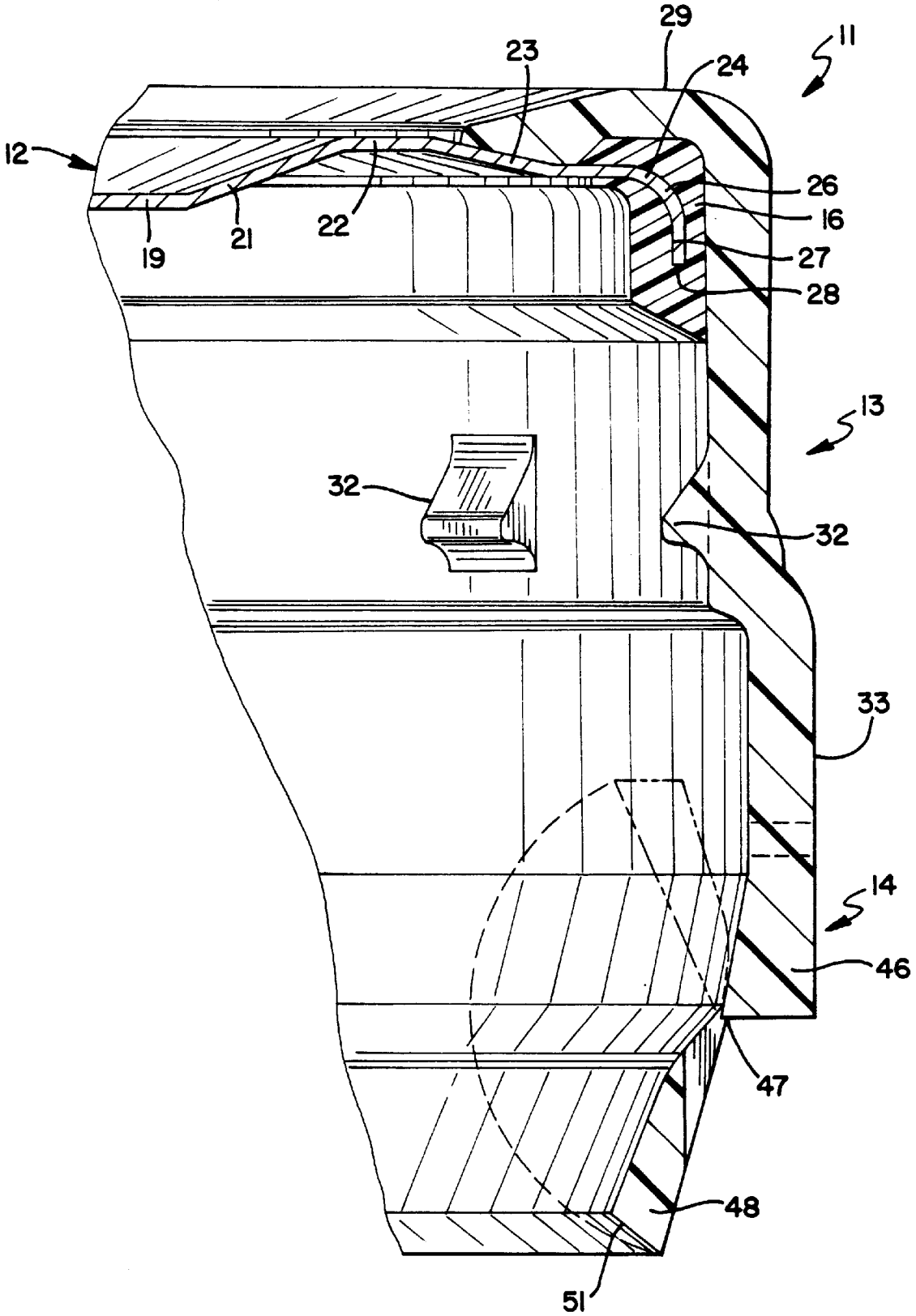
FIG. 5 is a vertical sectional view illustrating the closure of FIGS. 1–4 as formed and prior to the application of said closure to a container.

Flexible plastic skirt 13 includes an upper radially inwardly extending flange 29 which overlies the outer periphery of the end panel 12 and extends axially downwardly into the sidewall 31, the inner circumferential surface of which, in accordance with an important aspect of the present invention, as will be described in greater detail below, is provided with a plurality of circumferentially spaced lugs 32 which are integrally formed therewith. Flexible skirt 13 further extends into an enlarged axially downwardly extending cylindrical section 33, the terminal portion 34 of which is integrally connected to the tamper band 14 by means of a plurality of circumferentially disposed fracturable bridges 36 as best shown in FIG. 3. A plurality of drain holes 35 and wash windows 40 can be provided for facilitating the passage of moisture during the processing of a container to which the closure cap has been applied.

In the illustrated embodiment, flexible skirt 13 is in surrounding and capturing relation to end panel 12 in a manner by which the central portion of the end panel 12 is exposed, that is free of any overlying plastic material. Skirt 13 is suitably composed of any plastic resin which will afford the requisite flexibility required to enable the closure cap 11 to be axially applied to a container 37 (FIG. 2) so that the inwardly projecting lugs depicted by common reference numeral 32 will snap over a plurality of vertically spaced helical threads depicted by common reference numeral 38 on the container 37. As shown in FIG. 2, threads 38 are formed on the outer surface of a neck area 39 of the container 37 and are in generally parallel relationship to each other so as to define a plurality of helical grooves depicted by common reference numeral 41. Neck area 39 terminates at its upper end in a finish 42 which defines an open mouth 43 in the container. Suitable moldable resins for skirt 13 include thermoplastic or thermoset resins, however, homopolymers, copolymers and terpolymers of ethylene and/or propylene are generally preferred with propylene being especially preferred.

In the illustrated embodiment, gasket 16 is a side seal type and is preferably formed by molding. Gasket 16 can be composed of any resilient or elastomeric material (i.e. thermoplastic, thermoset and plastisol compositions) which provide the desired seal with the finish of a container. In this regard, however, vinylchloride-free resins or non-PVC materials are preferred.

Figure 7:
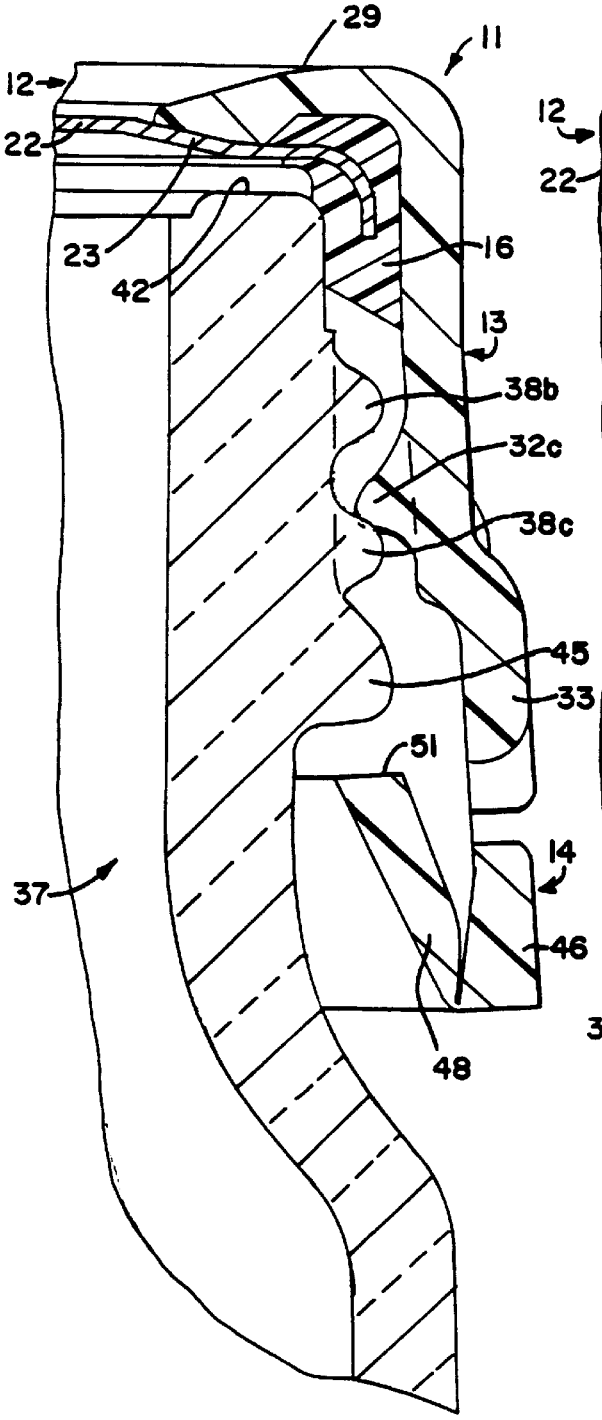
FIG. 7 is a vertical sectional view similar to FIG. 5 but showing the closure cap during an initial stage of the operation in which it is being applied to a container and prior to its being fully seated on said container.
Figure 8:
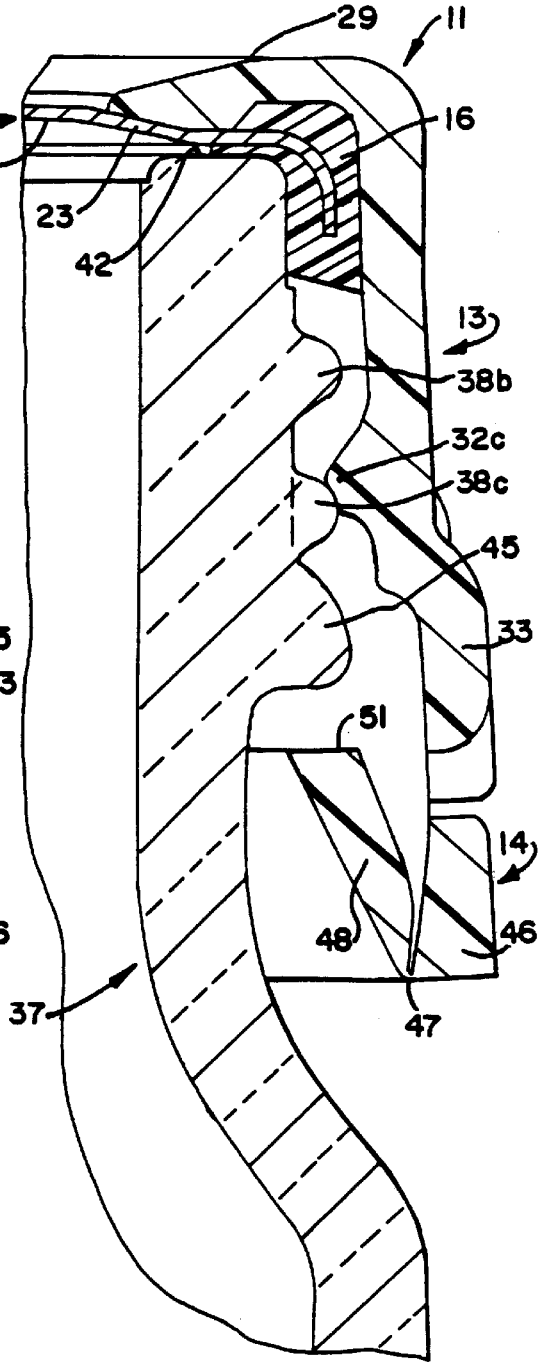
FIG. 8 is a view similar to FIG. 7 but showing the closure after it has been fully applied to the container and after the creation of a vacuum condition in the container.

As shown in FIGS. 7 and 8, tamper indicating band 14 is joined to the skirt by the bridges 36 at a location below a container retainer bead 45. In this regard, it will be observed that tamper indicating band 14 includes an upper portion 46 hingedly connected at 47 to a lower band portion 48. In the illustrated embodiment, the axial length of lower band portion 48 is greater than the axial length of the upper band portion 46. In this manner, when the closure is applied to a container, the terminal portion 51 of the lower band 48 extends radially inwardly and axially upwardly for engagement with the retainer bead 45 at a location above the circumferentially disposed bridges 36, thereby providing enhanced integrity of the frangible bridges. Inadvertent rupturing thereof is minimized, if not totally avoided, both during formation of the band (i.e. machine folding thereof) and also during application of the closure to a container.

Figure 9:
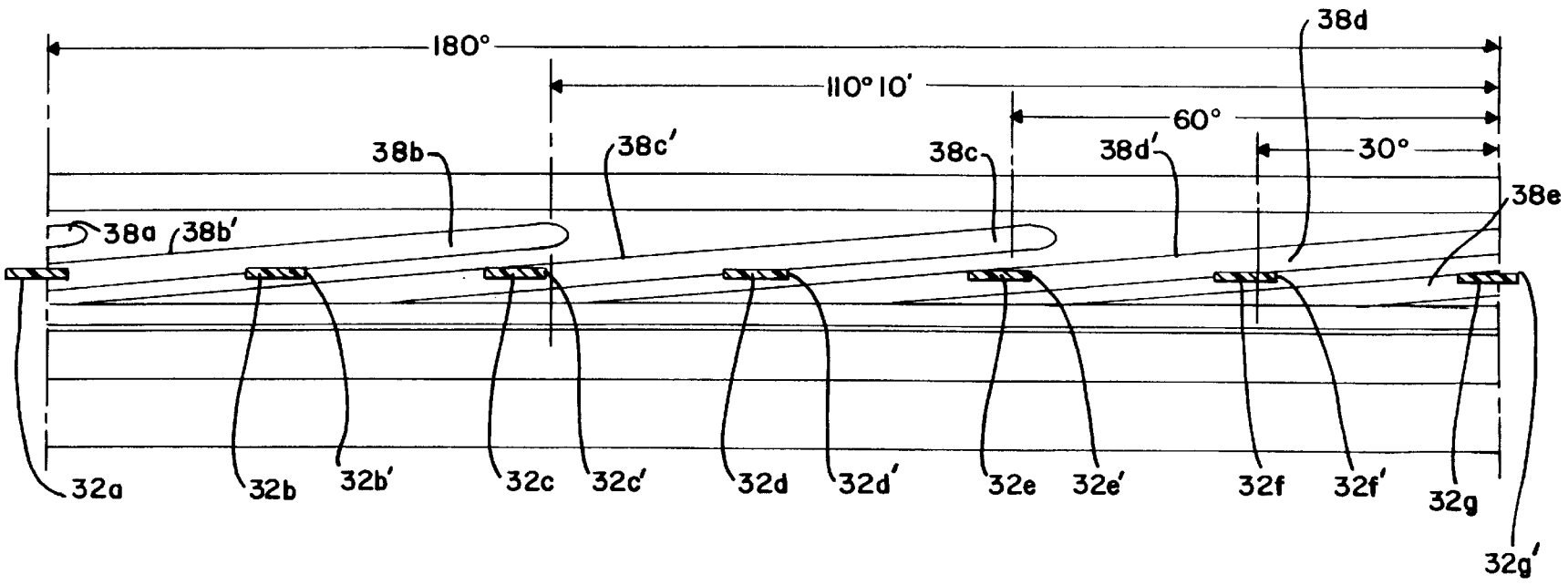
FIG. 9 is a schematic thread development illustration showing the orientation of the lugs on the skirt of the closure to the individual threads on the neck portion of the container.

Referring to FIGS. 7, 8 and 9, it will be observed that flexible skirt 13 and the lugs integrally formed therewith (lug 32*c* being specifically shown in FIGS. 7 and 8) are sized so that they provide an interference fit with the respective threads with which they come in contact (threads 38*b* and 38*c* being shown in FIGS. 7 and 8). The downward axial force imparted to the closure 11 during the application thereof to the container 37 causes the flexible skirt 13 to radially outwardly expand enabling the lugs to outwardly expand and ride over the threads with which they come in contact. An interference fit between at least some of the lugs and threads is thereby achieved as shown, for example, in FIGS. 8 and 9 with respect to lug 32*c* and helical thread 38*c*. This results in lug 32*c* being slightly deformed during the application of the closure cap 11 to the container 37. This interference fit serves to retain the closure on the container until a vacuum is formed. As shown in FIG. 9, similar interference fits are provided with the lugs 32*a* (with thread 38*b*), 32*e* (with thread 38*d*) and lug 32*g* (with thread 38*e*).

Correspondingly, as also shown in FIG. 9, lugs 32*b*, 32*d* and 32*f* are respectively at least partially received within the thread grooves 41*a,* 41*b* and 41*c*. In this manner, when the closure cap 11 is removed, the end face or leading edge 32*b*' of lug 32*b* will engage the upwardly inclined surface 38*c*' on thread 38*c,* thereby providing an upward camming action to the closure cap during such removal rotation. A similar camming off action is achieved by like cooperation of end or leading face 32*d*' of lug 32*d* with upwardly inclined surface 38*d*' of thread 38*d* and the leading edge or end face 32*f*' with upwardly inclined surface 38*e*' of thread 3e*e*.

It will be appreciated that the precise number of threads on a container and lugs on the closures of the present invention will depend upon the respective sizes of such closures and containers. In general, however, the present invention contemplates a ratio of lugs to threads of at least 1:1 with a ratio of lugs to threads of approximately 2:1 being particularly suitable for closures and containers having a nominal 51 mm diameter. Ratios of lugs to threads greater than 2:1, however, can be suitably employed and, in some applications, particularly those involving smaller diameter and containers, the ratio of lugs to threads can be less than 1:1. It should also be noted that the axial height of individual lugs should be such so that they will be in contact with only one helical thread at a given circumferential location and that the circumferential length of such lugs will be such that at least some of such lugs (for example, lugs 32*b,* 32*d* and 32*f* in FIG. 9) will be at least partially received within the respective helical grooves 41*a,* 41*b* and 41*c* to enable the previously described camming action to be achieved during rotational removal of the closure cap.

Sizing of the helical threads and spaced lugs will, in accordance with the present invention, provide a desired venting pressure release for release of pressures developed during storage particularly where internal pressures are produced in a container through unwanted circumstances such as occurs with product spoilage or fermentation. For example, with 51 mm closure caps which include twelve inwardly projecting lugs on glass containers wherein the thread depth is approximately 0.30 inch and the individual lugs project inwardly approximately 0.030 inch and the individual lugs have a circumferential length of approximately 0.125 inch with an axial height of approximately 0.030 inch, venting pressures below 10 psig are readily achievable.

Figure 10:
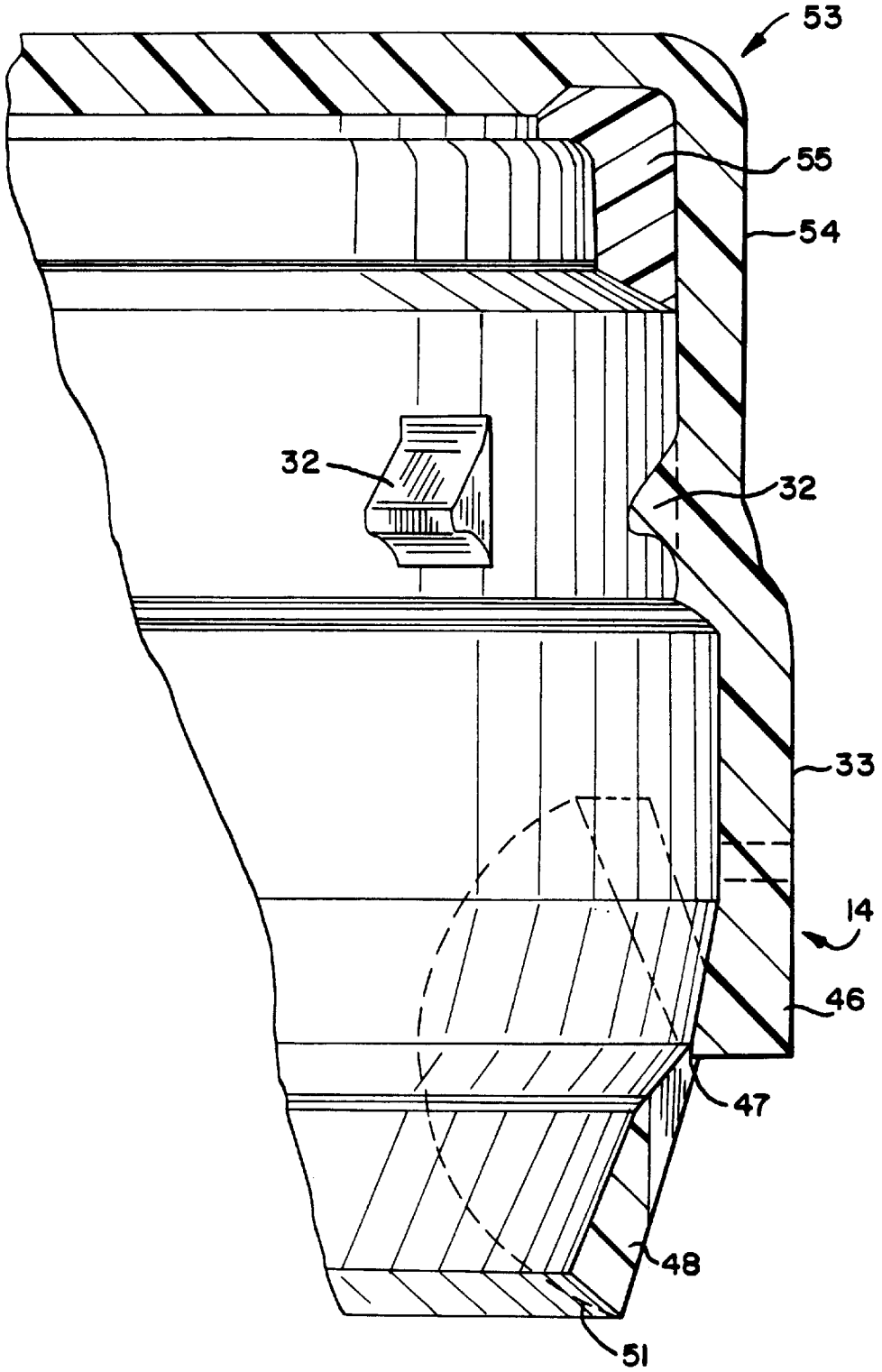
FIG. 10 is a fragmentary sectional view similar to FIG. 5 showing an alternate embodiment of the present invention.

The present invention can also be utilized in all plastic closures such as, for example, that depicted in FIG. 10. As shown therein, the closure cap 53 includes a one-piece molded cap shell 54 having a gasket 55 that provides a top and side seal. It will be appreciated, however, that the precise type of seal utilized in these closure caps can be modified to suit the particular end use application that is desired. Closure cap 53 includes a lug configuration for cooperative association with a plurality of vertically spaced threads on a neck of a container similar to that previously described.

The present invention has been described in the context of two embodiments. It will be apparent to those skilled in this art, however, that modifications and variations therefrom can be made without departing from the spirit and scope of this invention. Accordingly, this invention is to be construed and limited only by the scope of the appended claims.

We claim:

1. In combination, a closure and a container, said container having a mouth defined by a cylindrical neck which includes a plurality of vertically spaced helical threads formed on the outer surface thereof in generally parallel relationship to each other to define a corresponding plurality of helical grooves therebetween, said closure comprising:

an end panel sized and positioned to overlie said container mouth, a flexible cylindrical skirt extending downwardly from said end panel, said skirt having a cylindrical inner surface, a plurality of radially inwardly projecting spaced lugs having a base portion integral with and inwardly extending from said cylindrical inner surface of said skirt and a tip portion spaced radially inwardly from said cylindrical inner surface of said skirt, said lugs being circumferentially disposed around said inner cylindrical skirt surface and positioned thereon for engagement with select ones of the threads on the cylindrical neck of said container when said closure is fully seated on a neck finish of said container in sealing relationship therewith, said lugs being composed of a deformable plastic material and being sized so that when said closure is fully seated on said neck finish of said container an interference fit will be provided between the tip portion of at least one of said lugs and the maximum outer extent of a thread on said container in contact therewith, said spaced lugs having an axial height at any given circumferential location such that they will be in contact with only one of said helical threads, said lugs having a circumferential length which will permit at least one of them to be at least partially received within one of said helical grooves so that, upon rotation of said closure when said closure is seated on said neck finish of said container, a leading edge on said at least one groove-received lug will engage an upwardly inclined surface on an adjacent thread, thereby providing an upward camming action to said closure during such rotation, said flexible skirt and lugs being sized to permit said closure to be applied to said container by a direct axial, press-on action without requiring rotation thereof to effect the desired sealing of said closure on said container, and said flexible skirt and lugs being sized so that when said closure is applied to said container by said direct axial, press-on action, said flexible skirt expands radially outwardly enabling said lugs to ride over said threads until said closure is fully applied to said container.

2. The combination of claim 1 wherein said end panel and skirt are separately formed.

3. The combination of claim 2 wherein said end panel is formed of an oxygen barrier material.

4. The combination of claim 3 wherein said oxygen barrier material is metal.

5. The combination of claim 1 wherein said end panel and skirt comprise a one-piece molded cap shell.

6. The combination of claim 1 wherein said skirt is formed of a moldable resin selected from the group consisting of homopolymers, copolymers and terpolymers of ethylene and propylene.

7. The combination of claim 6 wherein said skirt is formed of polypropylene.

8. The combination of claim 1 wherein all of said lugs are positioned on said inner skirt surface at substantially the same elevation.

9. The combination of claim 1 wherein the ratio of lugs to helical threads is at least 1:1.

10. The combination of claim 1 wherein the ratio of lugs to helical threads is approximately 2:1.

11. The combination of claim 1 wherein the ratio of lugs to helical threads is greater than 2:1.

12. The combination of claim 1 wherein said container is formed of glass.

13. The combination of claim 1 wherein said container is formed of plastic.

14. In combination, a closure and a glass container, said glass container having a mouth defined by a cylindrical neck which includes a plurality of vertically spaced threads, each of which have an arcuate outer surface, said threads being formed on, and integral with, the outer surface of said cylindrical neck, said threads being in generally parallel relationship to each other and defining a plurality of helical grooves therebetween, said closure comprising:

an end panel sized and positioned to overlay said container mouth, a flexible skirt formed of a moldable polyolefin resin and extending downwardly from said end panel, said skirt having a cylindrical inner surface, a plurality of radially inwardly projecting spaced lugs having a base portion integral with and inwardly extending from said cylindrical inner surface of said skirt and a tip portion spaced radially inwardly from said cylindrical inner surface of said skirt, said lugs being integrally formed with said skirt and circumferentially disposed around said inner cylindrical skirt surface and positioned at substantially the same elevation for engagement with select ones of the threads on the cylindrical neck of said container when said closure is fully seated on a neck finish of said container in sealing relationship therewith, said integral lugs being sized so that when said closure is fully seated on said neck finish of said container an interference fit will be provided between the tip portion of at least one of said lugs and the maximum outer extent of a thread on said container in contact therewith, each of said spaced lugs having an axial height at any given circumferential location such that it will contact only one of said helical threads when said closure is seated on said container in sealing relationship therewith, said lugs having a circumferential length which will permit at least some of them to be at least partially received within said helical grooves so that, upon rotation of said closure when said closure is seated on said neck finish of said container, a leading edge on said groove-received lugs will engage an upwardly inclined surface on an adjacent thread, thereby imparting an upward camming action to said closure during such rotation, said flexible skirt and lugs being sized to permit said closure to be applied to said container by direct axial, press-on action without requiring rotation thereof to effect the desired sealing of said closure on said container, and said flexible skirt and lugs being sized so that when said closure is applied to said container, said flexible skirt expands radially outwardly enabling said lugs to ride over said threads until said closure is fully applied to said container.

15. The combination of claim 14 wherein the ratio of lugs to threads is at least 1:1.

16. The combination of claim 14 wherein the ratio of lugs to threads is approximately 2:1.

17. The combination of claim 14 wherein the ratio of lugs to threads is greater than 2:1.

18. The combination of claim 14 wherein said end panel and skirt are separately formed.

19. The combination of claim 18 wherein said end panel is formed of an oxygen barrier material.

20. The combination of claim 19 wherein said end panel is formed of metal.

21. The combination of claim 14 wherein said end panel and skirt comprise a one-piece molded cap shell.

22. The combination of claim 14 wherein said skirt and lugs are formed of polypropylene.

23. The combination of claim 21 wherein said one-piece molded cap shell is formed of polypropylene.

24. The combination of claim 1 wherein each of said lugs has a base portion and a tip portion, said base portion has a first cross-sectional area, said tip portion has a second cross-sectional area, and said first cross-sectional area is substantially greater than said second cross-sectional area.

25. The combination of claim 24 wherein the cross-sectional area taken at points along a surface of each said lug that extends between said base portion and said tip portion continually decreases in a direction extending from said base portion of each said lug to said tip portion of each said lug so that the cross-sectional area at any said point along said surface is greater than the cross-sectional area at all points closer to said tip portion.

26. The combination of claim 14 wherein each of said lugs has a base portion and a tip portion, said base portion has a first cross-sectional area, said tip portion has a second cross-sectional area, and said first cross-sectional area is substantially greater than said second cross-sectional area.

27. The combination of claim 26 wherein the cross-sectional area taken at points along a surface of each said lug that extends between said base portion and said tip portion continually decreases in a direction extending from said base portion of each said lug to said tip portion of each said lug so that the cross-sectional area at any said point along said surface is greater than the cross-sectional area at all points closer to said tip portion.

28. In combination, a closure and a container, said container having a mouth defined by a cylindrical neck which includes a plurality of vertically spaced threads formed on the outer surface thereof in generally parallel relationship to each other to define a corresponding plurality of grooves therebetween, said closure comprising:

an end panel sized and positioned to overlay said container mouth, a flexible cylindrical skirt extending downwardly from said end panel, said skirt having a cylindrical inner surface, a plurality of radially inwardly projecting spaced lugs having a base portion integral with and inwardly extending from said cylindrical inner surface of said skirt and a tip portion spaced radially inwardly from said cylindrical inner surface of said skirt, said lugs being circumferentially disposed around said inner cylindrical skirt surface and positioned thereon for engagement with select ones of the threads on the cylindrical neck of said container once said closure is seated on a neck finish of said container in sealing relationship therewith, said lugs being composed of a deformable plastic material and being sized so that when said closure is fully seated on said neck finish of said container an interference fit will be provided between the tip portion of at least one of said lugs and the maximum outer extent of a thread on said container in contact therewith, said spaced lugs having an axial height at any given circumferential location such that they will be in contact with only one of said threads, said lugs having a circumferential length which will permit at least one of them to be at least partially received within one of said grooves so that, upon rotation of said closure when said closure is seated on said neck finish of said container, a leading edge on said at least one groove-received lug will engage an upwardly inclined surface on an adjacent thread, thereby providing an upward camming action to said closure during such rotation, said flexible skirt and lugs being sized to permit said closure to be applied to said container by direct axial, press-on action without requiring rotation thereof to effect the desired sealing of said closure on said container.

29. The combination of claim 28 wherein said flexible skirt and lugs are sized so that when said closure is applied to said container by said direct axial, press-on action, said flexible skirt expands radially outwardly enabling said lugs to ride over said threads until said closure is fully applied to said container.

30. The combination of claim 28 wherein said base portion of each said lug has a first cross-sectional area, said tip portion of each said lug has a second cross-sectional area, and said first cross-sectional area is substantially greater than said second cross-sectional area.

31. The combination of claim 30 wherein the cross-sectional area taken at points along a surface of each said lug that extends between said base portion and said tip portion continually decreases in a direction extending from said base portion of each said lug to said tip portion of each said lug so that the cross-sectional area at any said point along said surface is greater than the cross-sectional area at all points closer to said tip portion.

32. The combination of claim 14 wherein said end panel and skirt are separately formed.

33. The combination of claim 14 wherein said end panel and skirt comprise a one-piece molded cap shell.

34. The combination of claim 14 wherein all of said lugs are axially spaced on said inner skirt surface at substantially the same elevation.

35. The combination of claim 14 wherein said base portion of each said lug has a first cross-sectional area, said tip portion of each said lug has a second cross-sectional area, and said first cross-sectional area is substantially greater than said second cross-sectional area.

36. The combination of claim 35 wherein the cross-sectional area taken at points along a surface of each said lugs that extends between said base portion and said tip portion continually decreases in a direction extending from said base portion of each said lug to said tip portion of each said lug so that the cross-sectional area at any said point along said surface is greater than the cross-sectional area at all points closer to said tip portion.

37. The combination of claim 28 wherein said end panel and skirt are separately formed.

38. The combination of claim 28 wherein said end panel and skirt comprise a one-piece molded cap shell.

39. The combination of claim 28 wherein all of said lugs are axially spaced on said inner skirt surface at substantially the same elevation.

40. The combination of claim 1 wherein said base portion of each said lug has a first cross-sectional area, said tip portion of each said lug has a second cross-sectional area, and said first cross-sectional area is substantially greater than said second cross-sectional area.

41. The combination of claim 40 wherein the cross-sectional area taken at points along a surface of each said lugs that extends between said base portion and said tip portion continually decreases in a direction extending from said base portion of each said lug to said tip portion of each said lug so that the cross-sectional area at any said point along said surface is greater than the cross-sectional area at all points closer to said tip portion.

* * * * *